US007387510B2

(12) United States Patent
Luo

(10) Patent No.: US 7,387,510 B2
(45) Date of Patent: Jun. 17, 2008

(54) LIGHTER WITH PIVOT NOZZLE

(76) Inventor: Xin Wen Luo, Luo Shui Industrial Zone, Xiogtan Town, Shunde District, Foshan City, Guangdong (CN)

( * ) Notice: Subject to any disclaimer, the term of this patent is extended or adjusted under 35 U.S.C. 154(b) by 389 days.

(21) Appl. No.: 11/150,710

(22) Filed: Jun. 9, 2005

(65) Prior Publication Data

US 2006/0281039 A1 Dec. 14, 2006

(51) Int. Cl.
*F23Q 7/12* (2006.01)

(52) U.S. Cl. ..... 431/255; 431/345; 431/277; 431/344

(58) Field of Classification Search ..... 431/255, 431/254, 277, 344, 345, 91
See application file for complete search history.

(56) References Cited

U.S. PATENT DOCUMENTS 6,488,492 B2 * 12/2002 Adams et al. ..... 431/153

* cited by examiner

*Primary Examiner*—Alfred Basichas
(74) *Attorney, Agent, or Firm*—Raymond Y. Chan; David and Raymond Patent Firm

(57) ABSTRACT

A lighter includes a pivot nozzle including a nozzle housing pivotally mounted at a lighter casing, a gas nozzle substantially supported in the nozzle housing in a stationary manner, and a retention skeleton having a predetermine flexibility is extended from a gas valve to the gas nozzle for guiding the gas emitting from a liquefied gas storage to the gas nozzle, wherein the nozzle housing is pivotally folded with respect to the lighter casing to selectively adjust a tilt angle of the gas nozzle while the retention skeleton retains the gas flowing towards the gas nozzle such that when the ignition button is depressed to depress the piezoelectric unit and to release the gas at the gas valve at the same time, the gas is emitted at the gas nozzle through the retention skeleton and is ignited by the sparks at the ignition tip of the piezoelectric unit.

14 Claims, 4 Drawing Sheets

LIGHTER WITH PIVOT NOZZLE

BACKGROUND OF THE PRESENT INVENTION

1. Field of Invention

The present invention relates to a lighter, and more particularly to a lighter which comprises a pivot nozzle pivotally connected to a lighter casing to selectively adjust a tilt angle of the pivot nozzle with respect to the lighter casing for ignition.

2. Description of Related Arts

Generally, a conventional lighter, such as a piezoelectric lighter, comprises a lighter casing having a liquefied fuel storage, a gas nozzle extended to a ceiling of the lighter casing and communicating with the liquefied fuel storage for controlling a flow of gas, a piezoelectric unit disposed in the lighter casing for generating sparks when the piezoelectric unit is depressed, and an ignition button slidably mounted on the lighter casing and arranged when the ignition button is depressed downwardly, the piezoelectric unit is depressed while the gas is released from the liquefied fuel storage to the gas nozzle and is ignited by the sparks.

However, such piezoelectric lighter has a major drawback that such piezoelectric lighter can provide a single ignition angle. Since the gas nozzle is fixed to the lighter casing in an upright manner, the gas can only upwardly ejected from the gas nozzle to form the flame when the lighter is ignited. For example, when the user wants to lighten up a candle, he or she may merely put the lighter at a slanted position that the gas nozzle is pointing at the top of the wick such that the flame can directly lighten the wick. Since the gas is upwardly ejected from the gas nozzle, the lighter cannot effectively lighten the candle when the lighter is in such slanted position.

In order to solve the above problem, the lighter manufacturer can make the piezoelectric lighter that the gas nozzle is inclinedly supported at the lighter casing such that the gas nozzle is adapted to directly pointing at the wick of the candle while the lighter casing is at an upright manner. However, such lighter is not practical use for lightening a cigarette. In addition, most users would like to use a utility lighter having an elongated gas nozzle tube to lighten up the candle. However, the utility lighter is bulky that the user is unable to carry the utility lighter in his or her pocket.

In addition, during the movement of the gas nozzle, the ignition tip of the piezoelectric unit may be forced to misalign with the gas nozzle which will cause the malfunction of the piezoelectric lighter.

SUMMARY OF THE PRESENT INVENTION

A main object of the present invention is to provide a lighter which comprises a pivot nozzle pivotally connected to a lighter casing to selectively adjust a tilt angle of the pivot nozzle with respect to the lighter casing for ignition.

Another object of the present invention is to provide a lighter, wherein a retention skeleton having a predetermine flexibility is extended from a liquefied gas storage to a gas nozzle such that when the pivot nozzle is pivotally moved with respect to the lighter casing, the retention skeleton substantially retains the gas-communication between the gas nozzle and the liquefied gas storage.

Another object of the present invention is to provide a lighter, wherein the gas nozzle is substantially supported within a nozzle housing in a stationary manner such that when the nozzle housing is pivotally folded with respect to the lighter casing, the gas nozzle is correspondingly retained in position so as to ensure the gas ejecting at the gas nozzle.

Another object of the present invention is to provide a lighter, wherein the ignition tip of the piezoelectric unit is supported stationary at a position closed to the nozzle housing of the gas nozzle for generating sparks such that during the movement of the pivot nozzle, the ignition tip of the piezoelectric unit is remained in position to align with the pivot nozzle so as to ensure the ignition operation of the lighter.

Another object of the present invention is to-provide a lighter, wherein the pivot movement of the pivot nozzle is controlled through a gear unit such that the tilt angle of the pivot nozzle can be adjustably locked up through the gear unit.

Another object of the present invention is to provide a lighter, which does not require to alter the original structural design of the lighter so as to minimize the manufacturing cost of the lighter incorporating with the pivot nozzle.

Another object of the present invention is to provide a lighter, wherein no expensive or complicated mechanism is required to employ in the piezoelectric lighter, so that the present invention successfully provides an economic and efficient solution not only for allowing the pivot nozzle to be pivotally fold to adjust the tilt angle of the lighter but also for facilitating the practical use of the lighter.

Accordingly, in order to accomplish the above objects, the present invention provides a lighter, comprising:

a lighter casing having a gas liquefied storage and comprising a top supporting frame;

a gas valve received in the lighter casing and communicating with the liquefied gas storage for controlling a flow of gas therefrom;

a piezoelectric unit, which is disposed in the lighter casing for generating piezoelectricity, comprising a movable operating part extended upwardly and an ignition tip arranged when the movable operating part is depressed downwardly, sparks are generated from the ignition tip;

an ignition button slidably mounted to the top supporting frame of the lighter casing to depress the movable operating part of the piezoelectric unit and to release the gas from the liquefied gas storage at the same time; and a pivot nozzle, which comprises:

a nozzle housing pivotally mounted at the top supporting frame of the lighter casing;

a gas nozzle substantially supported in the nozzle housing in a stationary manner, wherein the ignition tip of the piezoelectric unit is extended to a position closed to the gas nozzle; and a retention skeleton having a predetermine flexibility is extended from the gas valve to the gas nozzle for guiding the gas emitting from the liquefied gas storage to the gas nozzle, wherein the nozzle housing is pivotally folded with respect to the lighter casing to selectively adjust a tilt angle of the gas nozzle while the retention skeleton retains the gas flowing towards the gas nozzle such that when the ignition button is depressed to depress the movable operating part of the piezoelectric unit and to release the gas at the gas valve at the same time, the gas is emitted at the gas nozzle through the retention skeleton and is ignited by the sparks at the ignition tip of the piezoelectric unit.

These and other objectives, features, and advantages of the present invention will become apparent from the following detailed description, the accompanying drawings, and the appended claims.

DETAILED DESCRIPTION OF THE PREFERRED EMBODIMENT

Figure 1:
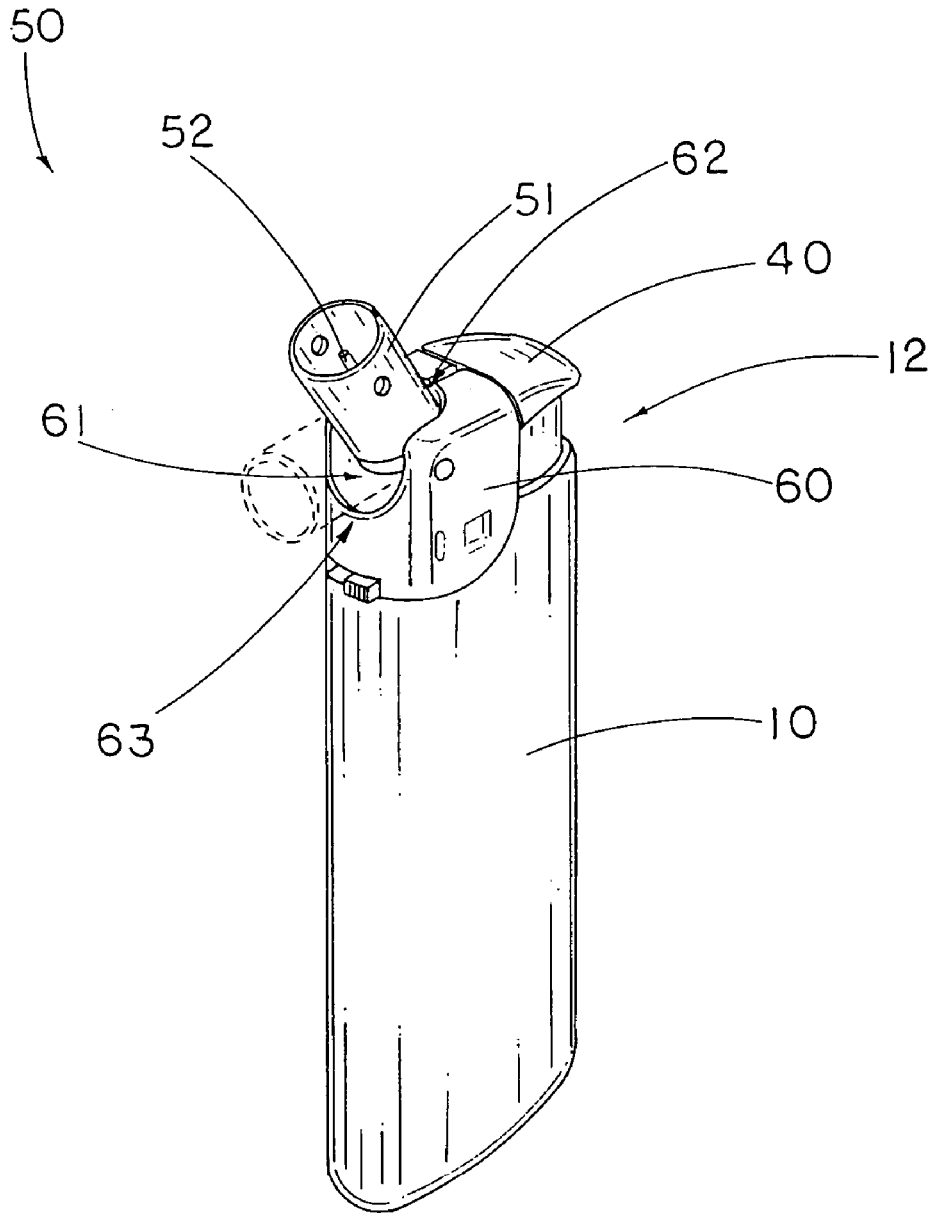
FIG. 1 is a perspective view of a lighter according to a preferred embodiment of the present invention.
Figure 2:
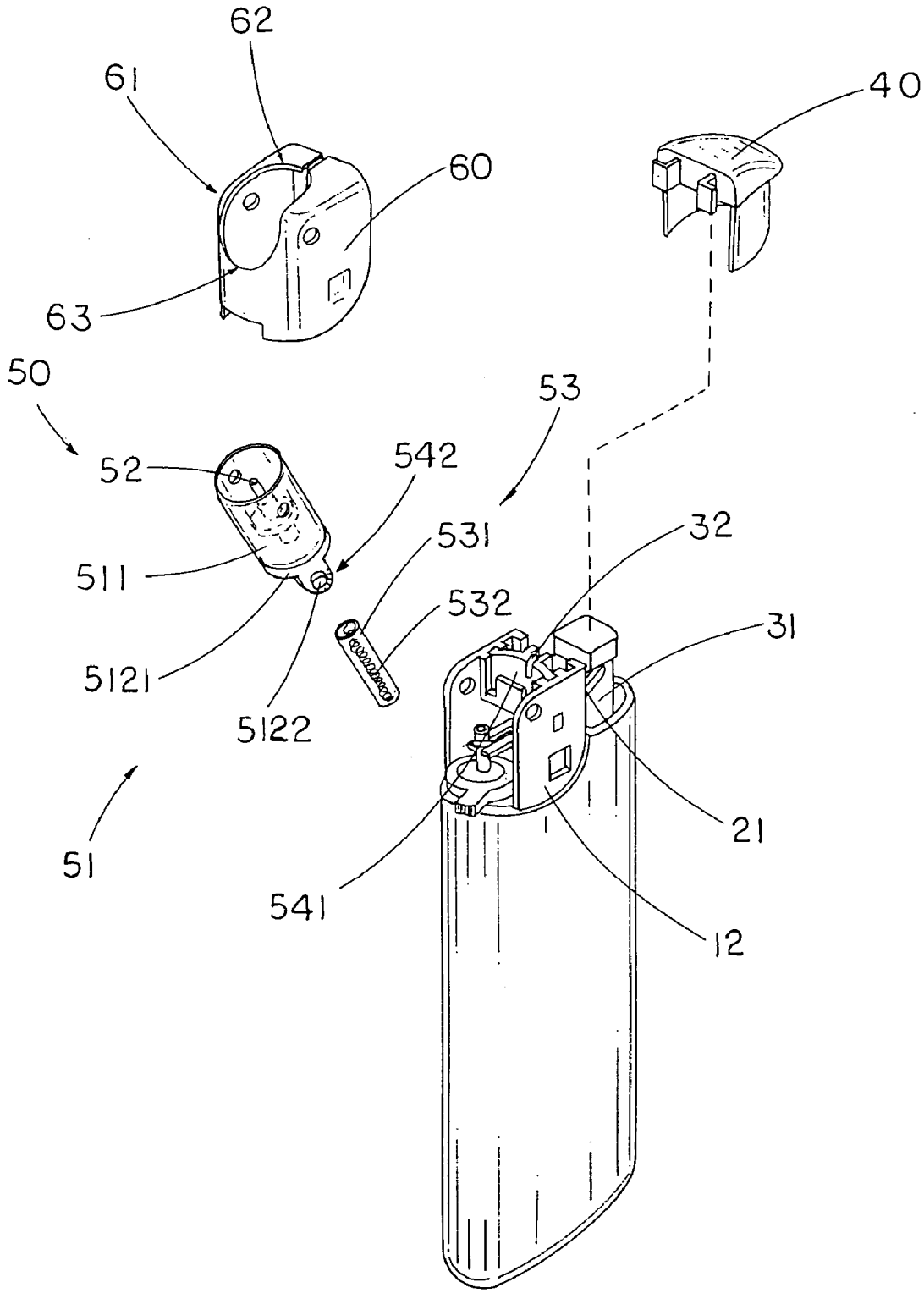
FIG. 2 is an exploded perspective view of the lighter according to the above preferred embodiment of the present invention.
Figure 3:
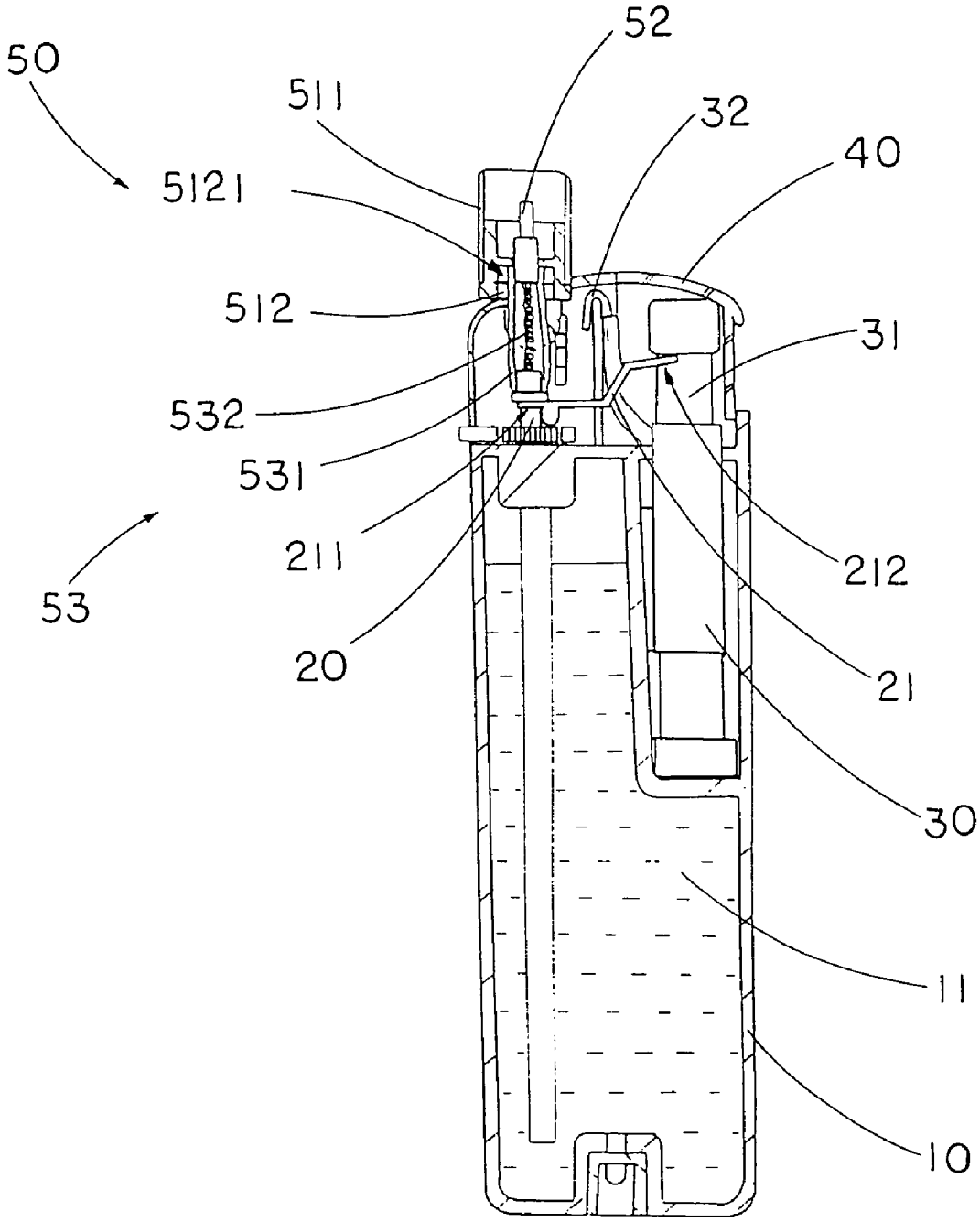
FIG. 3 is a sectional view of the lighter according to the above preferred embodiment of the present invention.
Figure 4:
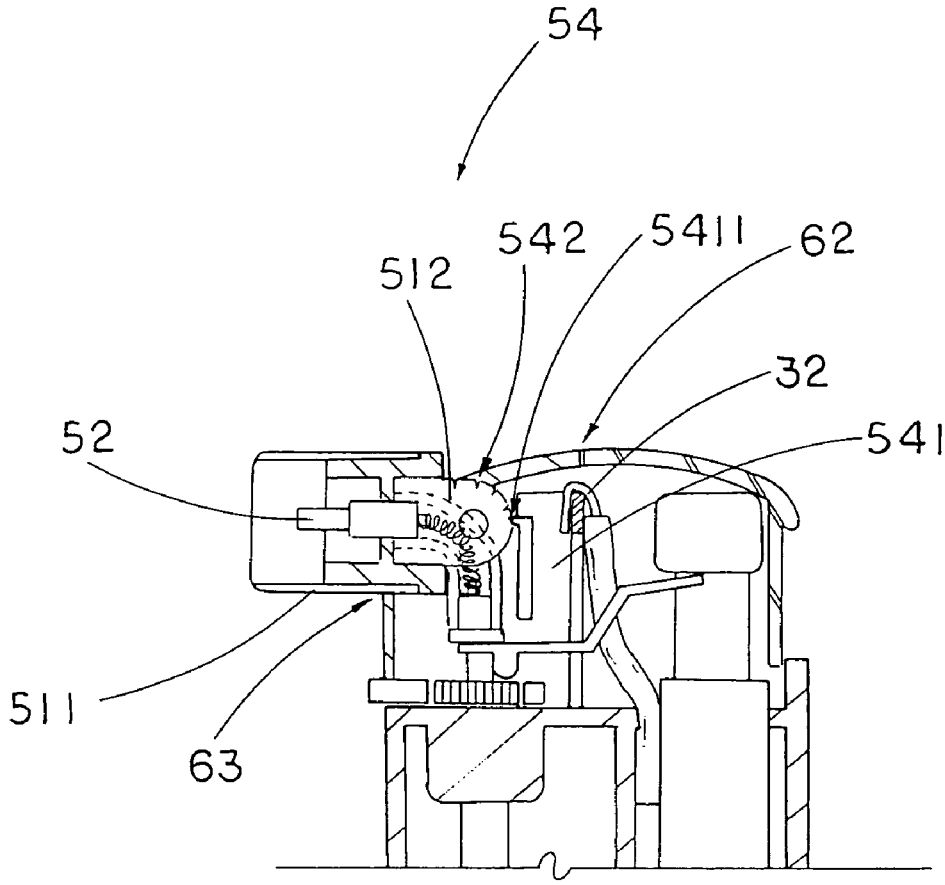
FIG. 4 is a sectional view of the pivot nozzle unit of the lighter according to the above preferred embodiment of the present invention.

Referring to FIGS. 1 through 3 of the drawings, a lighter according to a preferred embodiment of the present invention is illustrated, wherein the lighter comprises a lighter casing 10 having a gas liquefied storage 11 and comprising a top supporting frame 12, and a gas valve 20 received in the lighter casing 10 and communicating with the liquefied gas storage 11 for controlling a flow of gas therefrom.

The lighter further comprises a piezoelectric unit 30, an ignition button 40 and a pivot nozzle unit 50.

The piezoelectric unit 30, which is disposed in the lighter casing 10 for generating piezoelectricity, comprises a movable operating part 31 extended upwardly and an ignition tip 32 arranged when the movable operating part 31 is depressed downwardly, sparks are generated from the ignition tip 32.

The ignition button 40 is slidably mounted to the top supporting frame 12 of the lighter casing 10 to depress the movable operating part 31 of the piezoelectric unit 30 and to release the gas from the liquefied gas storage 11 at the same time.

The pivot nozzle 50 comprises a nozzle housing 51 pivotally mounted at the top supporting frame 12 of the lighter casing 10, a gas nozzle 52 substantially supported in the nozzle housing 51 in a stationary manner wherein the ignition tip 32 of the piezoelectric unit 30 is extended to a position closed to the gas nozzle 52, and a retention skeleton 53 having a predetermine flexibility is extended from the gas valve 20 to the gas nozzle 52 for guiding the gas emitting from the liquefied gas storage 11 to the gas nozzle 52.

Accordingly, the nozzle housing 51 is pivotally folded with respect to the lighter casing 10 to selectively adjust a tilt angle of the gas nozzle 52 while the retention skeleton 53 retains the gas flowing towards the gas nozzle 52 such that when the ignition button 40 is depressed to depress the movable operating part 31 of the piezoelectric unit 30 and to release the gas at the gas valve 20 at the same time, the gas is emitted at the gas nozzle 52 through the retention skeleton 53 and is ignited by the sparks at the ignition tip 32 of the piezoelectric unit 30.

According to the preferred embodiment, the lighter further comprises a gas lever 21, which is disposed in the lighter casing 10 in a pivotal movable manner, having an engaging end 211 engaged with the gas valve 20 and a depressible end 212 arranged in such a manner that when the depressible end 212 of the gas lever 21 is depressed downwardly by the ignition button 40, the engaging end 211 of the gas lever 21 lifts up the gas releasable valve 20 for releasing gas from the liquefied fuel storage 11.

The ignition button 40 is slidably supported on the top supporting frame 10 of the lighter casing 10 in a downward movable manner, wherein the ignition button 40 is rested on top of the movable operating part 31 of the piezoelectric unit 30 and is coupled at the depressible end 212 of the gas lever 21 such that when the ignition button 40 is depressed downwardly, the ignition button 40 depresses the movable operating part 31 of the piezoelectric unit 30 and the depressible end 212 of the gas lever 21 at the same time to generate the sparks at the ignition tip 32 of the piezoelectric unit 30 and release the gas from the gas valve 20 respectively.

As shown in FIGS. 2 and 3, the nozzle housing 51 comprises a tubular shelter 511, a nozzle platform 512, which is securely supported in the tubular shelter 511 to substantially mount the gas nozzle 52 within the tubular shelter 511 in a stationary manner pivotally mount at the top supporting frame 12 of the lighter casing 10, such that when the tubular shelter 511 is pivotally moved with respect to the lighter casing 10, the gas nozzle 52 is retained within the tubular shelter 511 in position.

According to the preferred embodiment, the nozzle platform 512 comprises a nozzle seat 5121 securely mounted to the gas nozzle 52 to retain the gas nozzle 52 in position and two pivot shafts 5122 outwardly extended to pivotally mount to two sidewalls of the top supporting frame 12 respectively so as to pivotally mount the gas nozzle 52 to the lighter casing 10.

The retention skeleton 53 comprises a flexible gas tube 531 sealedly extended from the gas valve 20 to the gas nozzle 52 for guiding the gas flowing towards the gas nozzle 52 and a resilient element 532, which is coaxially received in the gas tube 531, having two ends coupling at the gas valve 20 and the gas nozzle 52 respectively to retain a shape of the gas tube 531 so as to ensure the gas tube 531 connecting between the gas valve 20 and the gas nozzle 52 in a gas communicating manner.

It is worth to manner that when the nozzle housing 51 is pivotally moved to adjust the tilt angle of the gas nozzle 52, the gas tube 531 may accidentally be folded to block the gas passing therethrough. Therefore, the resilient element 532 is disposed in the gas tube 531 for applying an urging force against the gas tube 531 to retain the shape thereof so as to guarantee the gas is allowed to pass through the gas tube 531 towards the gas nozzle 52 for ignition. Accordingly, the resilient element 532 is a compression spring coupling between the gas valve 20 and the gas nozzle 52.

The pivot nozzle 50 further comprises a locking unit 54 for locking the tilt angle of the gas nozzle 52, wherein the locking unit 54 comprises a locker wall 541, having two spaced apart locking tips 5411, supported at the top supporting frame 12, and two locking gears 542 spacedly extended from the nozzle platform 512 to couple with the locking tips 5411 of the locker wall 541 respectively, such that when the nozzle housing 51 is pivotally moved with respect to the lighter casing 10, the locking gears 542 are driven to engage with the locking tips 5411 of the locker wall 541 respectively so as to retain the gas nozzle 53 at the tilt angle.

As shown in FIG. 3, the locking gears 542 are integrally extended from the nozzle platform 512 to couple with the locking tips 5411 of the locker wall 541 respectively. Furthermore, the ignition tip 32 of the piezoelectric unit 30 is securely supported at the locker wall 541 to retain the ignition tip 32 of the piezoelectric unit 30 at a position closed to the tubular shelter 511 such that when the piezoelectric unit 30 is depressed to generate the sparks at the ignition tip 32, the tubular shelter 511 transmits the sparks towards the gas nozzle 52 to ignite the gas emitting therefrom.

It is worth to mention that the tubular shelter 511, which is made of conductivity material, has a tapered pointer 5111 extended to a position closed to the gas nozzle 52 such that when the piezoelectricity generated at the ignition tip 32 of the piezoelectric unit 30, the tubular shelter 511 transmits the piezoelectricity at the tapered pointer 5111 to ignite the gas emitting at the gas nozzle 52. Therefore, when the nozzle housing 51 is pivotally moved to adjust the tilt angle of the gas nozzle 52, the ignition tip 32 of the piezoelectric unit 30 is retained in position at the locker wall 541 so as to ensure the ignition operation of the lighter of the present invention.

The lighter further comprises a shelter frame 60, which is securely mounted on the top supporting frame 12 of the lighter casing 10, having a L-shaped opening 61 defining a top blocking edge 62 and a bottom blocking edge 63, wherein the pivot nozzle 50 is slidably extended through the opening 61 of the shelter frame 60 to limit a pivotal movement of the pivot nozzle 50 between the top and bottom blocking edges 62, 63. In other words, the tubular housing 51 is adapted to pivotally fold to adjust the tilt angle of the gas nozzle 52 until the tubular housing 51 is blocked by the top and bottom blocking edges 62, 63 of the shelter frame 60.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighter, comprising:

a lighter casing having a gas liquefied storage and comprising a top supporting frame;

a gas valve received in said lighter casing and communicating with said liquefied gas storage for controlling a flow of gas therefrom;

a piezoelectric unit, which is disposed in said lighter casing for generating piezoelectricity, comprising a movable operating part extended upwardly and an ignition tip arranged when said movable operating part is depressed downwardly, sparks are generated from said ignition tip;

an ignition button slidably mounted to said top supporting frame of said lighter casing to depress said movable operating part of said piezoelectric unit and to release said gas from said liquefied gas storage at the same time; and a pivot nozzle, which comprises:

a nozzle housing pivotally mounted at the top supporting frame of said lighter casing;

a gas nozzle substantially supported in said nozzle housing in a stationary manner, wherein said ignition tip of said piezoelectric unit is extended to a position close to said gas nozzle; and a retention skeleton having a predetermine flexibility is extended from said gas valve to said gas nozzle for guiding said gas emitting from said liquefied gas storage to said gas nozzle, wherein said nozzle housing is pivotally folded with respect to said lighter casing to selectively adjust a tilt angle of said gas nozzle while said retention skeleton retains said gas flowing towards said gas nozzle such that when said ignition button is depressed to depress said movable operating part of said piezoelectric unit and to release said gas at said gas valve at the same time, said gas is emitted at said gas nozzle through said retention skeleton and is ignited by said sparks at the ignition tip of said piezoelectric unit, wherein said nozzle housing comprises a tubular shelter, a nozzle platform, which is securely supported in said tubular shelter to substantially mount said gas nozzle within said tubular shelter in a stationary manner, pivotally mounted at said top supporting frame of said lighter casing, such that when said tubular shelter is pivotally moved with respect to said lighter casing, said gas nozzle is retained within said tubular shelter in position, wherein said nozzle platform comprises a nozzle seat securely mounted to said gas nozzle to retain said gas nozzle in position and two pivot shafts outwardly extended to pivotally mount to two sidewalls of said top supporting frame respectively so as to pivotally mount said gas nozzle to said lighter casing.

2. A lighter, comprising:

a lighter casing having a gas liquefied storage and comprising a top supporting frame;

a gas valve received in said lighter casing and communicating with said liquefied gas storage for controlling a flow of gas therefrom;

a piezoelectric unit, which is disposed in said lighter casing for generating piezoelectricity, comprising a movable operating part extended upwardly and an ignition tip arranged when said movable operating part is depressed downwardly, sparks are generated from said ignition tip;

an ignition button slidably mounted to said top supporting frame of said lighter casing to depress said movable operating part of said piezoelectric unit and to release said gas from said liquefied gas storage at the same time; and a pivot nozzle, which comprises:

a nozzle housing pivotally mounted at the top supporting frame of said lighter casing;

a gas nozzle substantially supported in said nozzle housing in a stationary manner, wherein said ignition tip of said piezoelectric unit is extended to a position close to said gas nozzle; and a retention skeleton having a predetermine flexibility is extended from said gas valve to said gas nozzle for guiding said gas emitting from said liquefied gas storage to said gas nozzle, wherein said nozzle housing is pivotally folded with respect to said lighter casing to selectively adjust a tilt angle of said gas nozzle while said retention skeleton retains said gas flowing towards said gas nozzle such that when said ignition button is depressed to depress said movable operating part of said piezoelectric unit and to release said gas at said gas valve at the same time, said gas is emitted at said gas nozzle through said retention skeleton and is ignited by said sparks at the ignition tip of said piezoelectric unit.

wherein said retention skeleton comprises a flexible gas tube sealedly extended from said gas valve to said gas nozzle for guiding said gas flowing towards said gas nozzle and a resilient element, which is coaxially received in said gas tube, having two ends coupling at said gas valve and said gas nozzle respectively to retain a shape of said gas tube so as to ensure said gas tube connecting between said gas valve and said gas nozzle in a gas communicating manner, wherein said nozzle housing comprises a tubular shelter, a nozzle platform, which is securely supported in said tubular shelter to substantially mount said gas nozzle within said tubular shelter in a stationary manner, pivotally mounted at said top supporting frame of said lighter casing, such that when said tubular shelter is pivotally moved with respect to said lighter casing, said gas nozzle is retained within said tubular shelter in position, and wherein said nozzle platform comprises a nozzle seat securely mounted to said gas nozzle to retain said gas nozzle in position and two pivot shafts outwardly extended to pivotally mount to two sidewalls of said top supporting frame respectively so as to pivotally mount said gas nozzle to said lighter casing.

3. The lighter, as recited in claim 2, wherein said pivot nozzle further comprises a locking unit, which is adapted for locking said tilt angle of the gas nozzle, comprising a locker wall, having two spaced apart locking tips, supported at said top supporting frame, and two locking gears spacedly extended from said nozzle platform to couple with said locking tips of said locker wall respectively, such that when said nozzle housing is pivotally moved with respect to said lighter casing, said locking gears are driven to engage with said locking tips of said locker wall respectively so as to retain said gas nozzle at said tilt angle.

4. The lighter, as recited in claim 3, wherein said ignition tip of said piezoelectric unit is securely supported at said locker wall to retain said ignition tip of said piezoelectric unit at a position close to said tubular shelter such that when said piezoelectric unit is depressed to generate said sparks at said ignition tip, said tubular shelter transmits said sparks towards said gas nozzle to ignite said gas emitting therefrom.

5. A lighter, comprising:

a lighter casing having a gas liquefied storage and comprising a top supporting frame;

a gas valve received in said lighter casing and communicating with said liquefied gas storage for controlling a flow of gas therefrom;

a piezoelectric unit, which is disposed in said lighter casing for generating piezoelectricity, comprising a movable operating part extended upwardly and an ignition tip arranged when said movable operating part is depressed downwardly, sparks are generated from said ignition tip;

an ignition button slidably mounted to said top supporting frame of said lighter casing to depress said movable operating part of said piezoelectric unit and to release said gas from said liquefied gas storage at the same time; and a pivot nozzle, which comprises:

a nozzle housing pivotally mounted at the top supporting frame of said lighter casing;

a gas nozzle substantially supported in said nozzle housing in a stationary manner, wherein said ignition tip of said piezoelectric unit is extended to a position close to said gas nozzle; and a retention skeleton having a predetermine flexibility is extended from said gas valve to said gas nozzle for guiding said gas emitting from said liquefied gas storage to said gas nozzle, wherein said nozzle housing is pivotally folded with respect to said lighter casing to selectively adjust a tilt angle of said gas nozzle while said retention skeleton retains said gas flowing towards said gas nozzle such that when said ignition button is depressed to depress said movable operating part of said piezoelectric unit and to release said gas at said gas valve at the same time, said gas is emitted at said gas nozzle through said retention skeleton and is ignited by said sparks at the ignition tip of said piezoelectric unit, wherein said retention skeleton comprises a flexible gas tube sealedly extended from said gas valve to said gas nozzle for guiding said gas flowing towards said gas nozzle and a resilient element, which is coaxially received in said gas tube, having two ends coupling at said gas valve and said gas nozzle respectively to retain a shape of said gas tube so as to ensure said gas tube connecting between said gas valve and said gas nozzle in a gas communicating manner, wherein said resilient element is a compression spring disposed in said gas tube to couple between said gas valve and said gas nozzle for applying an urging force against said gas tube so as to retain said shape thereof, wherein said nozzle housing comprises a tubular shelter, a nozzle platform, which is securely supported in said tubular shelter to substantially mount said gas nozzle within said tubular shelter in a stationary manner, pivotally mounted at said top supporting frame of said lighter casing, such that when said tubular shelter is pivotally moved with respect to said lighter casing, said gas nozzle is retained within said tubular shelter in position, and wherein said nozzle platform comprises a nozzle seat securely mounted to said gas nozzle to retain said gas nozzle in position and two pivot shafts outwardly extended to pivotally mount to two sidewalls of said top supporting frame respectively so as to pivotally mount said gas nozzle to said lighter casing.

6. The lighter, as recited in claim 5, wherein said tubular shelter, which is made of conductivity material, has a tapered pointer extended to a position close to said gas nozzle such that when said piezoelectricity generated at said ignition tip of said piezoelectric unit, said tubular shelter transmits said piezoelectricity at said tapered pointer to ignite said gas emitting at said gas nozzle.

7. The lighter, as recited in claim 5, wherein said pivot nozzle further comprises a locking unit, which is adapted for locking said tilt angle of the gas nozzle, comprising a locker wall, having two spaced apart locking tips, supported at said top supporting frame, and two locking gears spacedly extended from said nozzle platform to couple with said locking tips of said locker wall respectively, such that when said nozzle housing is pivotally moved with respect to said lighter casing, said locking gears are driven to engage with said locking tips of said locker wall respectively so as to retain said gas nozzle at said tilt angle.

8. The lighter, as recited in claim 7, further comprising a shelter frame, which is securely mounted on said top supporting frame of said lighter casing, having a L-shaped opening defining a top blocking edge and a bottom blocking edge, wherein said pivot nozzle is slidably extended through said opening of said shelter frame to limit a pivotal movement of said pivot nozzle between said top and bottom blocking edges.

9. The lighter, as recited in claim 7, wherein said ignition tip of said piezoelectric unit is securely supported at said locker wall to retain said ignition tip of said piezoelectric unit at a position close to said tubular shelter such that when said piezoelectric unit is depressed to generate said sparks at said ignition tip, said tubular shelter transmits said sparks towards said gas nozzle to ignite said gas emitting therefrom.

10. The lighter, as recited in claim 9, wherein said tubular shelter, which is made of conductivity material, has a tapered pointer extended to a position close to said gas nozzle such that when said piezoelectricity generated at said ignition tip of said piezoelectric unit, said tubular shelter transmits said piezoelectricity at said tapered pointer to ignite said gas emitting at said gas nozzle.

11. The lighter, as recited in claim 10, further comprising a shelter frame, which is securely mounted on said top supporting frame of said lighter casing, having a L-shaped opening defining a top blocking edge and a bottom blocking edge, wherein said pivot nozzle is slidably extended through said opening of said shelter frame to limit a pivotal movement of said pivot nozzle between said top and bottom blocking edges.

12. A lighter, comprising:

a lighter casing having a gas liquefied storage and comprising a top supporting frame;

a gas valve received in said lighter casing and communicating with said liquefied gas storage for controlling a flow of gas therefrom;

a piezoelectric unit, which is disposed in said lighter casing for generating piezoelectricity, comprising a movable operating part extended upwardly and an ignition tip arranged when said movable operating part is depressed downwardly, sparks are generated from said ignition tip;

an ignition button slidably mounted to said top supporting frame of said lighter casing to depress said movable operating part of said piezoelectric unit and to release said gas from said liquefied gas storage at the same time; and a pivot nozzle, which comprises:

a nozzle housing pivotally mounted at the top supporting frame of said lighter casing;

a gas nozzle substantially supported in said nozzle housing in a stationary manner, wherein said ignition tip of said piezoelectric unit is extended to a position close to said gas nozzle; and a retention skeleton having a predetermine flexibility is extended from said gas valve to said gas nozzle for guiding said gas emitting from said liquefied gas storage to said gas nozzle, wherein said nozzle housing is pivotally folded with respect to said lighter casing to selectively adjust a tilt angle of said gas nozzle while said retention skeleton retains said gas flowing towards said gas nozzle such that when said ignition button is depressed to depress said movable operating part of said piezoelectric unit and to release said gas at said gas valve at the same time, said gas is emitted at said gas nozzle through said retention skeleton and is ignited by said sparks at the ignition tip of said piezoelectric unit, wherein said nozzle housing comprises a tubular shelter, a nozzle platform, which is securely supported in said tubular shelter to substantially mount said gas nozzle within said tubular shelter in a stationary manner, pivotally mounted at said top supporting frame of said lighter casing, such that when said tubular shelter is pivotally moved with respect to said lighter casing, said gas nozzle is retained within said tubular shelter in position, and wherein said pivot nozzle further comprises a locking unit, which is adapted for locking said tilt angle of the gas nozzle, comprising a locker wall, having two spaced apart locking tips, supported at said top supporting frame, and two locking gears spacedly extended from said nozzle platform to couple with said locking tips of said locker wall respectively, such that when said nozzle housing is pivotally moved with respect to said lighter casing, said locking gears are driven to engage with said locking tips of said locker wall respectively so as to retain said gas nozzle at said tilt angle.

13. The lighter, as recited in claim 12, wherein said ignition tip of said piezoelectric unit is securely supported at said locker wall to retain said ignition tip of said piezoelectric unit at a position close to said tubular shelter such that when said piezoelectric unit is depressed to generate said sparks at said ignition tip, said tubular shelter transmits said sparks towards said gas nozzle to ignite said gas emitting therefrom.

14. A lighter, comprising:

a lighter casing having a gas liquefied storage and comprising a top supporting frame;

a gas valve received in said lighter casing and communicating with said liquefied gas storage for controlling a flow of gas therefrom;

a piezoelectric unit, which is disposed in said lighter casing for generating piezoelectricity, comprising a movable operating part extended upwardly and an ignition tip arranged when said movable operating part is depressed downwardly, sparks are generated from said ignition tip;

an ignition button slidably mounted to said top supporting frame of said lighter casing to depress said movable operating part of said piezoelectric unit and to release said gas from said liquefied gas storage at the same time; and a pivot nozzle, which comprises:

a nozzle housing pivotally mounted at the top supporting frame of said lighter casing;

a gas nozzle substantially supported in said nozzle housing in a stationary manner, wherein said ignition tip of said piezoelectric unit is extended to a position close to said gas nozzle; and a retention skeleton having a predetermine flexibility is extended from said gas valve to said gas nozzle for guiding said gas emitting from said liquefied gas storage to said gas nozzle, wherein said nozzle housing is pivotally folded with respect to said lighter casing to selectively adjust a tilt angle of said gas nozzle while said retention skeleton retains said gas flowing towards said gas nozzle such that when said ignition button is depressed to depress said movable operating part of said piezoelectric unit and to release said gas at said gas valve at the same time, said gas is emitted at said gas nozzle through said retention skeleton and is ignited by said sparks at the ignition tip of said piezoelectric unit, wherein said retention skeleton comprises a flexible gas tube sealedly extended from said gas valve to said gas nozzle for guiding said gas flowing towards said gas nozzle and a resilient element, which is coaxially received in said gas tube. having two ends coupling at said gas valve and said gas nozzle respectively to retain a shape of said gas tube so as to ensure said gas tube connecting between said gas valve and said gas nozzle in a gas communicating manner, wherein said resilient element is a compression spring disposed in said gas tube to couple between said gas valve and said gas nozzle for applying an urging force against said gas tube so as to retain said shape thereof, wherein said nozzle housing comprises a tubular shelter, a nozzle platform, which is securely supported in said tubular shelter to substantially mount said gas nozzle within said tubular shelter in a stationary manner, pivotally mounted at said top supporting frame of said lighter casing, such that when said tubular shelter is pivotally moved with respect to said lighter casing, said gas nozzle is retained within said tubular shelter in position, and wherein said tubular shelter, which is made of conductivity material, has a tapered pointer extended to a position close to said gas nozzle such that when said piezoelectricity generated at said ignition tip of said piezoelectric unit, said tubular shelter transmits said piezoelectricity at said tapered pointer to ignite said gas emitting at said gas nozzle.

* * * * *